US007908976B2

(12) United States Patent
Pujol

(10) Patent No.: US 7,908,976 B2
(45) Date of Patent: Mar. 22, 2011

(54) RAILWAY VEHICLE AND DEVICE FOR ACCESSING SAID VEHICLE

(75) Inventor: Claude Pujol, Rueil Malmaison (FR)

(73) Assignee: Alstom Transport SA, Levallcis Perret (FR)

( * ) Notice: Subject to any disclaimer, the term of this patent is extended or adjusted under 35 U.S.C. 154(b) by 54 days.

(21) Appl. No.: 12/166,555

(22) Filed: Jul. 2, 2008

(65) Prior Publication Data

US 2009/0090266 A1 Apr. 9, 2009

(30) Foreign Application Priority Data

Jul. 2, 2007 (FR) ..... 07 04764

(51) Int. Cl.
*B61D 17/00* (2006.01)

(52) U.S. Cl. ..... 105/422; 105/375; 105/425; 104/31

(58) Field of Classification Search ..... 105/329.1, 105/340, 341, 370, 371, 372, 375, 422, 436, 105/425; 104/27, 28, 29, 30, 31
See application file for complete search history.

(56) References Cited

U.S. PATENT DOCUMENTS 2,980,034 A * 4/1961 Harty ..... 104/31
3,006,008 A * 10/1961 Loomis et al. ..... 14/71.3
3,730,361 A * 5/1973 Haynes ..... 414/537
3,892,088 A * 7/1975 Fleenor ..... 49/37
4,016,991 A * 4/1977 Oldford ..... 414/400
4,270,630 A * 6/1981 Karkau ..... 187/200
4,273,498 A * 6/1981 Dickhart et al. ..... 414/556
4,559,659 A * 12/1985 Hunter, Jr. ..... 14/71.3
4,616,957 A * 10/1986 Burrows et al. ..... 405/179
4,685,860 A * 8/1987 McFarland ..... 414/720
4,694,522 A * 9/1987 Alten ..... 14/71.1
4,765,455 A * 8/1988 Matsuno et al. ..... 198/779
4,879,843 A * 11/1989 Hamamoto et al. ..... 49/158
4,927,316 A * 5/1990 Kordel ..... 414/510
5,006,034 A * 4/1991 Bragg et al. ..... 414/555
5,148,751 A * 9/1992 Alten et al. ..... 104/31
5,165,839 A * 11/1992 Aoki ..... 414/541
5,230,288 A * 7/1993 Bickel ..... 105/425
5,314,290 A * 5/1994 Lutz et al. ..... 414/509
5,357,869 A * 10/1994 Barjolle et al. ..... 105/436
5,375,962 A * 12/1994 Kempf ..... 414/541
5,641,262 A * 6/1997 Dunlop et al. ..... 414/557
(Continued)

FOREIGN PATENT DOCUMENTS

DE 199 14 965 A1 10/2000
(Continued)

*Primary Examiner* — S. Joseph Morano
*Assistant Examiner* — Jason C Smith
(74) *Attorney, Agent, or Firm* — Sughrue Mion, PLLC

(57) ABSTRACT

A railway vehicle including an access platform which extends between two lateral faces, at least one of the faces having a lateral access door. The access platform is adjacent a passenger area and includes a plate which is movable vertically so as to allow passengers with reduced mobility to access/leave the access platform from/to a railway platform of a given height when the movable plate is placed in a given embarkation/disembarkation position. Also included is a moving floor allowing persons with reduced mobility to move between said passenger area and said movable plate whatever the embarkation/disembarkation position thereof. The moving floor is located and always remains in an interior of the vehicle along with the passenger area and the movable plate between which the moving floor is located.

12 Claims, 4 Drawing Sheets

U.S. PATENT DOCUMENTS

| | | | | |
|---|---|---|---|---|
| 6,105,905 | A * | 8/2000 | Spence | 246/127 |
| 6,173,653 | B1 * | 1/2001 | Edelmann | 104/27 |
| 6,360,668 | B1 * | 3/2002 | Rauch | 104/30 |
| 6,401,624 | B1 * | 6/2002 | Nijenhuis | 104/29 |
| 6,443,072 | B2 * | 9/2002 | Rizk | 105/343 |
| 7,025,004 | B2 * | 4/2006 | Neugebauer | 105/437 |
| 2001/0025585 | A1 * | 10/2001 | Rizk | 105/343 |
| 2001/0042489 | A1 * | 11/2001 | Yamaguchi et al. | 104/30 |
| 2005/0217533 | A1 * | 10/2005 | Le Bellec et al. | 105/329.1 |
| 2005/0223933 | A1 * | 10/2005 | Crosbie et al. | 104/31 |
| 2008/0134930 | A1 * | 6/2008 | Drago | 105/436 |
| 2009/0090266 | A1 * | 4/2009 | Pujol | 104/31 |
| 2009/0255437 | A1 * | 10/2009 | Hachet et al. | 105/344 |

FOREIGN PATENT DOCUMENTS

| | | | |
|---|---|---|---|
| DE | 101 13 074 | A1 | 9/2002 |
| EP | 1 787 883 | A1 | 5/2007 |
| FR | 2 873 635 | | 2/2006 |

* cited by examiner

RAILWAY VEHICLE AND DEVICE FOR ACCESSING SAID VEHICLE

BACKGROUND OF THE INVENTION

The invention relates to a railway vehicle comprising an access platform which extends transversely between two lateral faces, said access platform being adjacent to at least one passenger zone. The access platform comprises a plate which is movable vertically so as to allow persons with reduced mobility to gain access to the vehicle from railway platforms of different heights.

Such a vehicle is described in patent application DE19914965. The above-mentioned patent application describes a vehicle comprising a movable plate which has a position in which the movable plate and the floor of the passenger zones are coplanar. The movable plate is displaced vertically in order to allow persons with reduced mobility to gain access to the vehicle from a railway platform the height of which is different from the height of the floor of the passenger zones.

When the movable plate is displaced vertically, a step is created, in the vehicle, between the movable plate and the floor of the passenger areas adjacent to the movable plate.

Such a vehicle has the disadvantage of presenting a risk to passengers when a step is created between the movable plate and the floor of the adjacent passenger areas. In addition, owing to those steps, persons with reduced mobility who access the movable plate, from a railway platform, when it is in the access position do not have access to the rest of the vehicle; such persons must wait until the movable plate of the access platform is repositioned in the same plane as the floor of the passenger zones in order to gain access to the rest of the vehicle.

In addition, the vehicle of the prior art, in which the plate is movable vertically, has the disadvantage that it does not allow persons with reduced mobility to gain access to the vehicle from all railway platforms without assistance. In particular, the superelevation of the track in a station varies according to whether the track is curved or not. In addition, wear of the wheels and compression of the vehicle suspension causes lowering and tilting of the vehicle. On account of those parameters, the vertically movable plate has random positions with more or less great inclinations relative to the railway platform.

In addition, the distance from the vehicle to the railway platform in the transverse direction varies as a function of the concave or convex shape of the railway platform.

It is considered that, in order to allow persons with reduced mobility to gain access to the train without assistance, the space that is left between the access zone to the vehicle and the train must have horizontal and vertical components each less than 75 millimetres and preferably less than 50 millimetres. Such distances allow the small wheels of wheelchairs to pass safely without external assistance.

A vehicle of the prior art has the disadvantage that it does not always allow persons with reduced mobility to gain access to the vehicle from a railway platform without assistance because the space that is left between the movable plate and the railway platform can be important.

It is an aim of the invention to propose a vehicle which ensures that persons with reduced mobility have good access to a passenger area from an access platform.

It is another aim of the invention to propose a vehicle which ensures that persons with reduced mobility have independent access to a passenger area from a railway platform.

SUMMARY OF THE INVENTION

To that end, the invention relates to a railway vehicle comprising an access platform which extends between two lateral faces, at least one of the faces comprising a lateral access door, the access platform being adjacent to at least one passenger area and comprising a plate which is movable vertically in order to allow passengers with reduced mobility to access/leave the access platform from/to a railway platform of height $Q_i$ when said movable plate is placed in an embarkation/disembarkation position, characterized in that said vehicle comprises at least one means of passage allowing persons with reduced mobility to move between said passenger area and said movable plate whatever the embarkation/disembarkation position $E_i$ thereof.

According to particular embodiments, the railway vehicle has one or more of the following characteristics taken in isolation or according to all technically possible combinations:

- the means of passage provides the connection between said movable plate and a fixed floor of the passenger area;
- the means of passage is a movable floor which extends longitudinally between said movable plate and said fixed floor;
- the movable floor is joined to the movable plate and to the fixed floor so as to form a longitudinal ramp between the movable plate and the fixed floor;
- the inclination of said ramp varying when the movable plate is displaced vertically between an embarkation/disembarkation position $E_i$ and an embarkation position $E_j$, where i is different from j.
- the access platform comprises adjusting means which make it easier for persons with reduced mobility to access said vehicle 1 from a railway platform of height $Q_i$ situated opposite the adjusting means;
- the adjusting means comprise a movable pallet which extends between the movable plate and a lateral access door, said movable pallet being capable of pivoting relative to the movable plate about a substantially horizontal longitudinal axis;
- the adjusting means comprise a closure means suitable for limiting the distance between the movable pallet and a railway platform.

The invention relates also to an access device comprising an access platform, said access platform comprising a plate which is movable vertically in order to allow passengers with reduced mobility to gain access to the access platform from a railway platform of height $Q_i$ when said movable plate is placed in an embarkation/disembarkation position, characterized in that the access device further comprises:

- at least one means of passage allowing persons with reduced mobility to move between a passenger area and said movable plate whatever the embarkation/disembarkation position $E_i$ thereof.

According to particular embodiments, the access device comprises one or more of the following characteristics taken in isolation or according to all technically possible combinations:

- said access device further comprises adjusting means which facilitate the movement of persons with reduced mobility between said movable plate and a railway platform;
- the means of passage is a movable floor which extends longitudinally between said movable plate and a fixed floor of a passenger zone, said movable floor being joined to the movable plate and to the fixed floor;

The invention relates also to a method of adjusting the position of the access device, characterized in that it comprises:

a step of detecting the railway platform, a step of calculating the best arrangement of the access device in which the ramps formed by said movable floor and the adjusting means are less than 8%, a step of bringing the movable plate into its embarkation position $E_i$, a step of disposing at least the adjusting means disposed opposite the railway platform in an adjusting position in which the adjusting means reduces the distance from the access platform to the railway platform.

Other characteristics and advantages of the invention will become apparent from the description of an embodiment given hereinbelow.

BRIEF DESCRIPTION OF THE DRAWINGS

It will be given with reference to the accompanying drawings, in which:

FIG. 2 shows an access device according to the invention having a movable plate disposed in an embarkation/disembarkation position E0;

FIG. 3 shows an access device according to the invention having a movable plate disposed in an embarkation/disembarkation position E1;

FIG. 4 shows an access device according to the invention, a movable plate of which is disposed in a position E2;

FIG. 5 shows a means for adjusting the distance of the vehicle from a railway platform, in a rest position;

FIG. 6 shows a means for adjusting the distance of the vehicle from a railway platform, in an adjusting position.

DETAILED DESCRIPTION OF THE INVENTION

Figure 1:
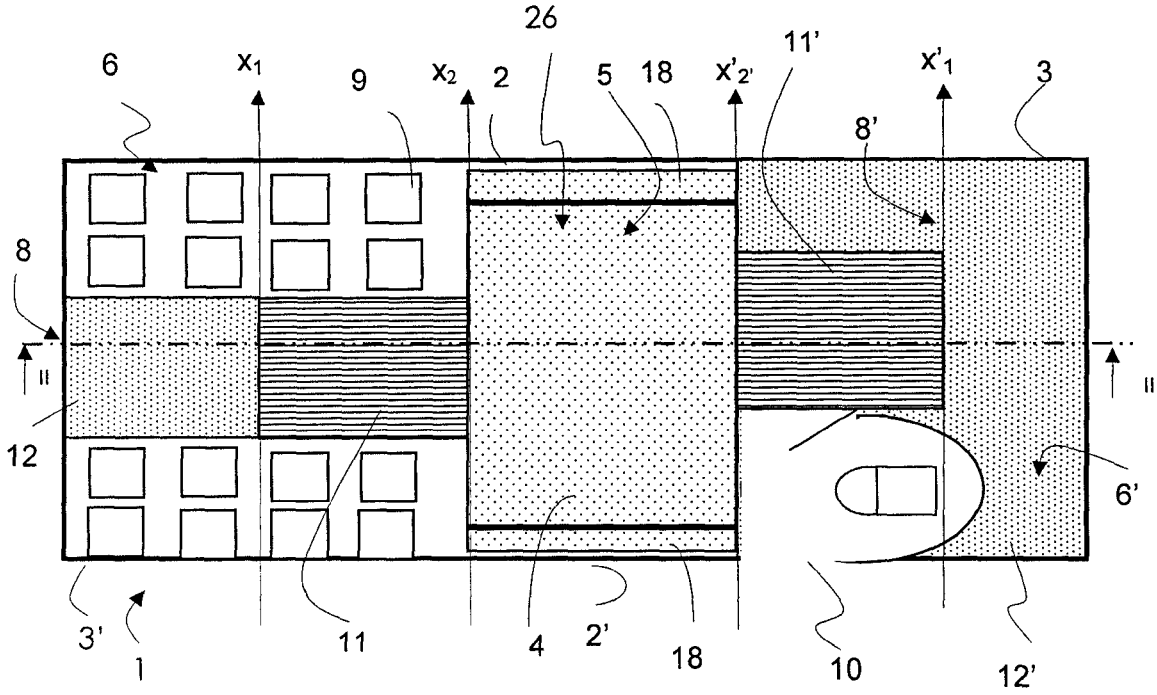
FIG. 1 shows diagrammatically a top view of a railway vehicle according to the invention.

As is shown in FIG. 1, a railway vehicle 1 comprises two doors 2 and 2' which are opposite one another and are provided in the two lateral walls 3 and 3' of the vehicle.

The vehicle comprises an access device 26 comprising an access platform 4 which extends transversely between the two lateral walls 3 and 3' and longitudinally over the entire width of the access doors 2 and 2'.

In another embodiment, only one lateral face 3 comprises an access door 2, behind which the platform 4 extends.

The platform 4 comprises a vertically movable plate 5. "Vertically movable" is understood as meaning that the plate is capable of moving in a direction perpendicular to the plane formed by the chassis 25 of the vehicle.

In the embodiment shown in FIG. 1, the plate 5 extends over the entire length of the access platform 4. The movable plate 5 extends transversely between two adjusting means 18 and 18'. The adjusting means 18 and 18' extend between the movable plate 5 and an access door 2 and 2', respectively.

In other embodiments, the plate 5 occupies a longitudinal portion of the access platform 4.

By way of variation, the plate 5 extends over the entire width of the access platform 4.

Passenger areas 6 and 6' are provided on each side of the access platform 4. The passenger areas 6 and 6' comprise seats 9 as well as other areas including toilets 10 and circulation zones 8 and 8'.

The passenger areas 6 and 6' comprise means of passage 11 and 11' provided on each side of the access platform 4, in the longitudinal direction.

The means of passage 11 and 11' are joined to fixed floors 12 and 12', respectively. The fixed floors 12 and 12' are disposed on each side of the access platform 4 in a passenger area 6 and 6', respectively.

A means of passage 11, 11' is capable of providing the connection between the movable plate 5 and a fixed floor 12 or 12'. In the embodiment shown in FIG. 1, the means of passages 11 and 11' are movable floors.

The movable floors 11 and 11' extend longitudinally between a first and second end, respectively, of the movable plate 5 and an end of a fixed floor 12 and 12', respectively. The movable floor 11 is joined to the movable plate 5 and to the fixed floor 12 at a first end of the movable plate 5 and an end of the fixed floor 12 which is opposite to the first end of the movable plate 5. The movable floor 11' is joined to the movable plate 5 and to the fixed floor 12' at a second end of the movable plate 5 and an end of the fixed floor 12' which is opposite the second end of the movable plate 5.

"Joined" is understood as meaning that the plane formed by the movable floor 11 is permanently attached to the respective ends of the movable plate 5 and of the fixed floor 12 while being movable relative to the movable plate 5 and to the fixed floor 12. The same is true of the movable floor 11' relative to the movable plate 5 and to the fixed floor 12'.

To that end, a movable floor 11 or 11' is, for example, connected to the movable plate 5 and to a fixed floor 12 or 12' by means of articulated couplings, ball couplings or elastic couplings. Such couplings are suitable for allowing the movable floor 11 or 11' to pivot relative to the fixed floor 12 or 12' about axes of rotation x1 or x'1 and relative to the movable floor 5 about an axis x2 or x'2.

The axis x2 or x'2 extends along the end of the plate 5 that is joined to the movable floor 11 or 11'. The axis x1 or x'1 extends along the end of the fixed floor 12 or 12' that is joined to said movable floor 11 or 11'. The axes x1 and x2 as well as x'1 and x'2 are substantially horizontal and extend in the transverse direction of the vehicle 1. The axes x2 and x'2 extend vertically at the same height as the movable plate 5. The axes x2 and x'2 are movable vertically at the same time as the movable plate 5.

By way of variation, the movable floor 11 is joined to the fixed floor 12 by means of, for example, a sliding coupling between them. In that embodiment, the movable floor 11 is capable of sliding beneath the fixed floor 12 while remaining joined to one end of the fixed floor 12.

As will be seen more precisely hereinbelow, the means of passage 11 and 11' constitute means of passage which are capable of allowing persons with reduced mobility to easily gain access to the passenger areas 6 and 6' from the movable plate 5 and vice versa.

The access device 26 comprising the access platform 4, which is equipped with a movable plate 5 and adjusting means 18 and 18', and with means of passage 11 and 11' is suitable for allowing persons with reduced mobility to move between the passenger areas 6 and 6' and the movable plate 5 independently and without disturbing the movement of the other passengers.

By way of variation, the vehicle 1 comprises only one passenger area 6 disposed on one side of the access platform 4. In this configuration, the vehicle comprises a single means of passage 11 suitable for allowing persons with reduced mobility to move between the movable plate 5 and a passenger area 6. The other side of the platform 4 is, for example, joined directly to an end of the vehicle 1.

In another variant, the vehicle comprises two passenger areas 6 and 6', only one of which is equipped with a means of passage 11.

Figure 2:
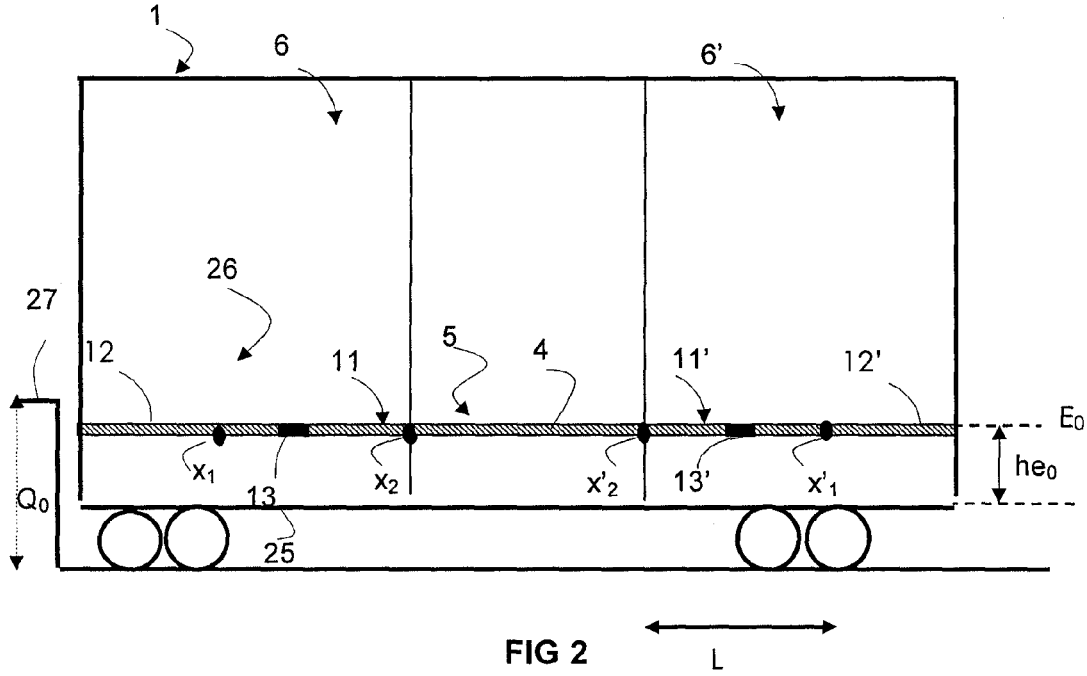
FIG. 2 is a diagrammatic representation of a longitudinal section of a railway vehicle 1 according to the invention, taken according to a cutting plane II-II which extends vertically in the longitudinal direction of the vehicle 1.
Figure 3:
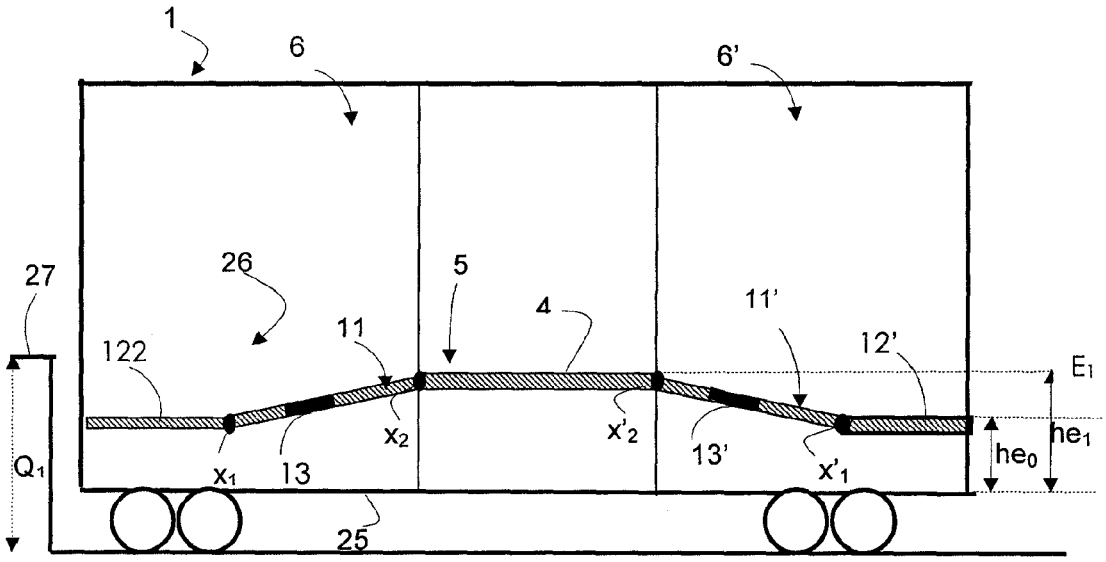
FIG. 3 is a diagrammatic representation of a longitudinal section of a railway vehicle 1 according to the invention, taken according to a cutting plane II-II which extends vertically in the longitudinal direction of the vehicle 1.
Figure 4:
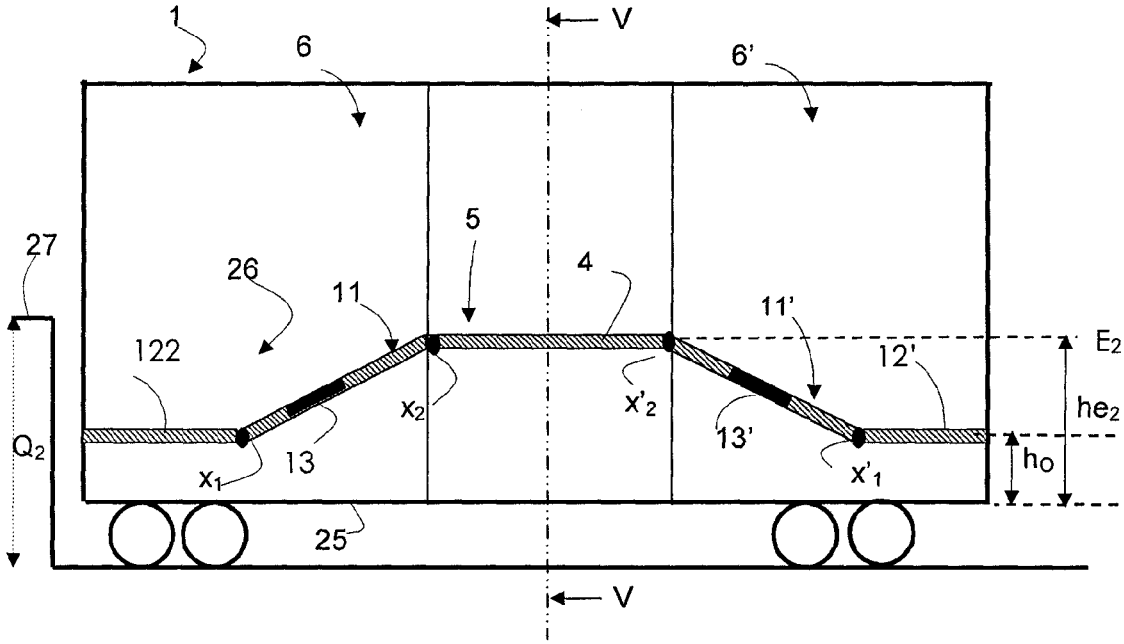
FIG. 4 is a diagrammatic representation of a longitudinal section of a railway vehicle 1 according to the invention, taken according to a cutting plane II-II which extends vertically in the longitudinal direction of the vehicle 1.

FIGS. 2, 3 and 4 show diagrammatically a longitudinal section of a railway vehicle 1 taken according to a cutting plane II-II shown in FIG. 1. The cutting plane II-II extends vertically in the longitudinal direction of the vehicle 1.

FIG. 2 shows the access device 26 of the railway vehicle 1 when the movable plate 5 is in an initial position $E_0$. In the initial position $E_0$, the movable plate 5 is disposed at a height $he_0$ relative to the chassis 25 of the vehicle.

In that position, as is shown in FIG. 2, the movable plate 5 is coplanar with the movable floors 11, 11' and the fixed floors 12, 12' of the passenger zones 6 and 6' disposed on each side of the access platform 4.

When the movable plate 5 is in position E0, it allows a person with reduced mobility to gain access to the vehicle, without assistance, from a railway platform of height $Q_0$ which is less than $Q_1$.

The movable plate in position $E_0$ is, for example, disposed at the same height as the railway platform of height $Q_0$ or at a different height, as will be seen in the following description.

The movable plate 5 is, for example, in position E0 when the vehicle 1 arrives at a station whose railway platform 27 is at a height $Q_1$.

FIG. 3 shows the railway vehicle 1 in which the movable plate 5 is in an embarkation position $E_1$.

In order to allow persons with reduced mobility to embark/disembark easily from/to a railway platform 27 of height $Q_1$ which is greater than $Q_0$, the movable plate 5 has been displaced vertically from a position $E_0$ at a height $he_0$ to an embarkation/disembarkation position $E_1$ at a height $he_1$. The height $he_1$ of the movable plate 5 relative to the chassis 25 of the vehicle is greater than the height $he_0$.

When the movable plate 5 is in the embarkation/disembarkation position $E_1$, it is not coplanar with the portions of fixed floor 12 and 12' of the passenger zones 6 and 6', respectively.

When the movable plate 5 is in position $E_1$, the movable floors 11 and 11' providing the connection between the movable plate 5 and the fixed floors 12 and 12', respectively, are sloping. The movable floors 11 and 11' each form a downward longitudinal ramp between the end of the movable plate 5 to which they are joined and the end of the fixed floor 12 or 12', respectively, to which they are joined.

The ramps formed by the movable floors 11 and 11' between the fixed floors 12 and 12', respectively, and the movable plate 5 allow persons with reduced mobility to gain access to the fixed floors 12 and 12' from the movable plate 5 and vice versa.

The movable floors 11 and 11' forming means of passages from the movable plate 5 to the fixed floors 12 and 12' to which they are joined by way of the movable floor 3 therefore have the advantage of allowing persons with reduced mobility to move between the movable plate 5 and the circulation zones 8 even when the movable plate 5 is in an embarkation position E1, where i=0, 1, 2, 3, . . . r, in which it is not coplanar with the fixed floor zones 12 and 12'.

FIG. 4 shows the access device 26 when the movable plate 5 of the railway vehicle 1 is in a position $E_2$. In the embarkation/disembarkation position $E_2$, the movable plate 5 is disposed at a height $he_2$ relative to the chassis 25 of the vehicle. The height $he_2$ is greater than the height $he_1$ so as to allow persons with reduced mobility to gain access to the vehicle from a railway platform 27 of height $Q_2$ greater than $Q_1$.

When the movable plate 5 is in position $E_2$, the difference in height between the movable plate 5 and the fixed floors 12 and 12' is greater than when the movable plate 5 is in position $E_1$, and the longitudinal ramps formed by the movable floors 11 and 11' therefore have steeper slopes than when the movable plate 5 is in position E1.

The invention has the advantage that steps are not formed between the movable plate 5 and that the movement of passengers in the vehicle 1 is not impeded when a person with reduced mobility boards said vehicle, because a person with reduced mobility who gains access to the movable plate 5 is not forced to wait for the movable plate 5 to be placed in position E0 to be able to access the passenger zones 6 and 6'. Likewise, a person with reduced mobility who is located in a passenger zone 6 or 6' does not have to wait for the movable plate 5 to be disposed at the same height as the fixed floor 12 or 12' before he can gain access to the movable plate 5.

In addition, the fact that steps are not formed between a fixed floor 12 or 12' of a passenger zone 6 or 6' and the movable plate 5 reduces the risk of falling for persons with reduced mobility and for other users of the railway vehicle.

In the embodiment shown in FIGS. 2, 3 and 4, the movable floor 11 or 11' is joined to the movable plate 5 by way of an articulated coupling x2 or x'2 and is joined to the fixed floor 12 or 12' by way of an articulated coupling of axis x1 or x'1.

When the movable plate 5 is displaced vertically between an initial embarkation/disembarkation position $E_i$ and an embarkation position $E_j$, where i is different from j, the movable floor 11 or 11' pivots relative to the movable plate 5 and to the fixed floor 12 or 12', about axes x2 and x1 or x'2 and x'1, so that the slope of the movable floor 11 or 11' varies.

The movable floor 11 or 11' comprises adjustment means 13 or 13' which are capable of changing the length of said movable floor 11 or 11'. The movable floor 11 or 11' has, for example, an extensible zone 13 or 13', as shown in FIGS. 2, 3 and 4, allowing the movable floor 11 or 11' to establish a permanent connection between the movable plate 5 and the fixed floor 12 or 12' when the slope of the movable floor 11 or 11' varies.

In another embodiment, a movable floor 11 or 11' is joined to the movable plate 5 by articulated coupling means and is capable of sliding beneath the fixed floor 12 or 12' when the movable plate 5 is displaced vertically.

The movable floor zones 11, 11' are preferably sufficiently wide to allow persons with reduced mobility to move on those zones.

Advantageously, the length L separating the ends of the fixed floor 12 or 12' and of the movable plate 5 that are joined by the movable floor 11 or 11' is sufficient for the longitudinal ramp formed by the movable floor 11 or 11' between those two ends to be always less than 10% and preferably less than 8% and more particularly from 4 to 8%, whatever the height of the embarkation position $E_i$ of the movable plate 5. The independent movement of persons with reduced mobility is in fact facilitated on small slopes.

Figure 5:
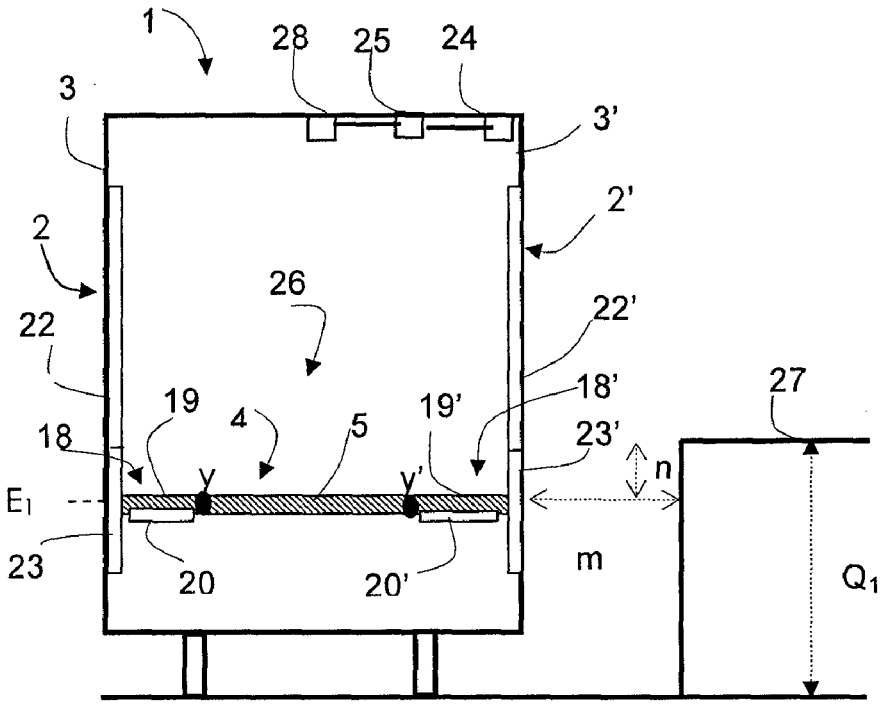
FIG. 5 shows diagrammatically a transverse section of the vehicle according to the vertical plane V-V which extends in the longitudinal direction of the vehicle, shown by a dotted line in FIG. 4.
Figure 6:
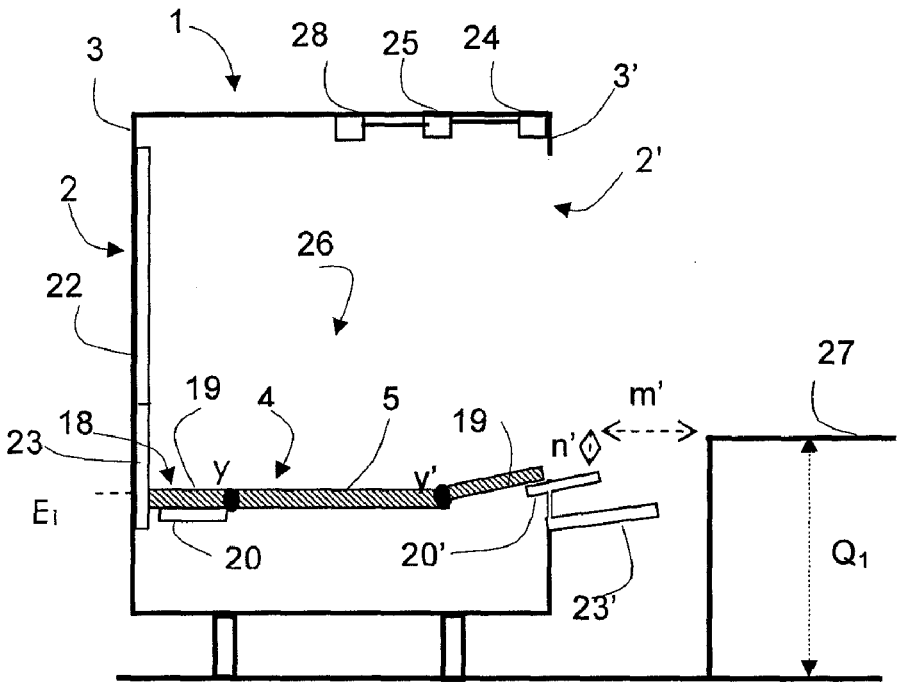
FIG. 6 shows diagrammatically a transverse section of the vehicle according to the vertical plane V-V which extends in the longitudinal direction of the vehicle, shown by a dotted line in FIGS. 3 and 4.

FIGS. 5 and 6 show diagrammatically transverse sections of the vehicle, according to the vertical plane V-V, which extends in the longitudinal direction of the vehicle and is shown by a dotted line in FIGS. 3 and 4. In FIG. 5, adjusting means 18 and 18' have been shown in the rest position.

The access platform 4 comprises adjusting means 18 and 18' which are suitable for facilitating the movement of passengers between the movable plate 5 and a railway platform 27 located opposite the adjusting means 18 or 18'. The adjusting means 18 and 18' are capable of bringing the access platform 4 closer to a railway platform 27 by limiting the horizontal distance m and/or the vertical distance n separating the access platform 4 from a railway platform 27. The adjusting means 18 and 18' thus form a passage between a railway platform 27 and the movable plate 5.

An adjusting means 18 or 18' comprises a movable pallet 19 or 19' which extends transversely between the movable plate 5 and a lateral access door 2 or 2'.

The movable pallet 19 or 19' is capable of adjusting the vertical distance n between the access platform 4 and a railway platform 27 located opposite the face 2 or 2'.

The movable pallet 19 or 19' is capable of pivoting relative to the movable plate 5 about a substantially horizontal axis y or y' which extends in the longitudinal direction of the vehicle. The axes y and y' extend at the interface between the movable plate 5 and the movable pallets 19 and 19'. The axes y and y' are therefore movable vertically with the movable plate 5.

Pivoting of the movable pallet 19 or 19' is permitted by means for coupling the movable pallet 19 or 19' to the movable plate 5, the coupling means being of the articulated or elastic or pivot type.

The adjusting means 18 or 18' comprises a closure means 20 or 20' capable of closing off a gap between the access platform 4 and a railway platform 27 which is disposed opposite the lateral access door 2 or 2'. The closure means 20 or 20' is capable of reducing the vertical distance n and the horizontal distance m of the access platform 4 relative to the railway platform 27 disposed opposite the lateral access door 2 or 2'.

The closure means 20 or 20' is fixed beneath the movable pallet 19 or 19'. The closure means 20 or 20' is capable of being displaced between a retracted position, in which it is accommodated beneath the movable pallet 19 or 19', and a deployed position, in which it projects from the vehicle and extends outside the vehicle between the vehicle 1 and a railway platform 27.

The closure means 20 or 20' moves from its retracted position to its deployed position by sliding along said movable pallet 19 or 19' so as to project from the vehicle 1.

FIGS. 5 and 6 show a vehicle stationed next to a railway platform 27, the railway platform 27 being opposite a lateral access door 2'. There will now be described, in the following text, only the operation of the adjusting device 18', which is located opposite the railway platform 27 of height Q1.

As is shown in FIG. 5, before the door 2' is opened, the movable plate 5 is in an embarkation/disembarkation position E1 and the adjusting device 18' is in a rest position in which the movable pallet 19' is coplanar with the movable plate 5 and in which the closure means 20 is disposed entirely beneath the movable pallet 19'. In that position, the access platform 4, that is to say the end of the movable pallet 19' facing the railway platform 27, is located at a vertical distance n and a horizontal distance m from the railway platform 27.

As is shown in FIG. 6, when the door 22' is opened in order to allow the passengers to enter and leave the vehicle, the adjusting device 18' is in an adjusting position in which the movable pallet 19' is inclined relative to the movable plate 5 and the closure means 20' is deployed and disposed as an extension of the movable pallet 19'.

The access platform 4 is positioned at a vertical distance n' and a horizontal distance m' from the railway platform 27. The distances n' and m' are smaller than the distances n and m and are preferably less than 75 millimetres, which facilitates the movement of persons with reduced mobility between the railway platform 27 and the access platform 4.

The adjusting means 18' then forms a transverse ramp which extends between the movable plate 5 and the railway platform 27.

The adjusting means 18 extending between the movable plate 5 and the lateral face 3 is in its rest position in FIGS. 5 and 6 because it is not situated opposite an access platform 27.

In an embodiment, the adjusting means 18' can be used to limit the amplitude of the vertical movements of the movable plate 5 relative to a position E0 in which it is coplanar with a movable floor 12, 12'. For example, the movable plate 5 can be disposed in an embarkation/disembarkation position E'1 at a height h'1 relative to the chassis 25 that is less than the height h1 in order to allow passengers to gain access to the vehicle 1 from a railway platform 27 of height Q1. The distance between the railway platform 27 and the access platform 4 being reduced by the adjusting means 18'.

That embodiment has the advantage that it allows passengers to move between a railway platform 27 of height Q1 and the access platform 4 while reducing the gradients of the ramps formed by a movable floor 11, 11' between the movable plate 5 and a fixed floor 12, 12' when the movable plate 5 is in an embarkation position E'1, relative to a situation in which the movable plate 5 is in a position E1.

There will now be described a method which facilitates the access and exit of persons with reduced mobility to/from a vehicle 1 having a movable plate 5, disposed in an embarkation/disembarkation position E0, and the movement of persons with reduced mobility inside the vehicle 1 when the vehicle 1 is stopped in a station having a railway platform 27 at a height Q1.

When the vehicle 1 is stopped in a station, the positioning of the access device 26 is activated by an activating means (not shown). The activating means comprises push-buttons disposed inside and outside the vehicle on the lateral faces close to the access doors. The push-buttons can be operated by a person with reduced mobility or by any other passenger.

In another embodiment, the means for activating the positioning of the access device 26 is, for example, a remote control or a control device disposed in the driver's cabin of the vehicle, which can be activated by a person with reduced mobility and by the driver of the vehicle 1.

The means for activating the positioning of the access device 26 sends a command for positioning of the access device 26 to an on-board computer (not shown), which carries out the steps of the method described hereinbelow.

The vehicle 1 comprises a detection means 24 capable of detecting the railway platform 27. The detection means 24 is, for example, an infrared beam, a camera or a laser.

When the command for activation of the access device is sent to the on-board computer 28, the detection means 24 detects the railway platform 27 and transmits the information to a calculator 25, which calculates the distance separating the platform 4 from the railway platform 27. The calculator 25 calculates the best configuration of the access device 26 to allow optimum movement of persons with reduced mobility between the railway platform 27 and the passenger zones 6 and 6'.

The best arrangement of the access device 26 is a compromise in which the vertical position of the movable plate 5 and the position of the adjusting means 18, 18' are chosen so that the distance from the access platform 4 to the railway platform 27 is minimal, and in which the ramps formed by the movable plate 5 and the movable floors 11 and 11' do not exceed 8%.

Preferably, the gradients of the ramps formed by the adjusting means 18', and more precisely by the movable pallet 19' and the closure means 20', do not exceed 8%.

The door 2' opposite the railway platform 27 comprises a top leaf 22' which is capable of being displaced in the longitudinal direction between a closed position and an open position in which passengers are able to enter and leave the vehicle. A bottom leaf 23' extends beneath the top leaf 22'. The bottom leaf 23' is suitable for pivoting about a substantially horizontal longitudinal axis in such a manner as to exhibit a position in which it leaves an empty space between the top leaf 22' and the bodywork of the vehicle, in order to allow positioning of the adjusting device 18' in an adjusting position.

The calculator 25 transmits the information relating to the best arrangement of the access device to the on-board computer.

At the same time as calculating the best arrangement of the access device 26, the calculator 25 orders the bottom leaf 23' of the door 2' to be lowered so as to leave the space free for the extension of the adjusting means 20'.

Given that, when the closure means is brought into a deployed position, it projects from the vehicle, between the vehicle and the railway platform, the on-board computer 28 combines the information coming from the calculator 25 with traction information so that it does not deploy the adjusting device 20' when the vehicle is moving on the track.

This makes it possible to prevent the device 20' from striking a railway platform 27.

The on-board computer 28 orders the positioning of the access device 26 by the activation of means for driving the movable plate 5 and the adjusting means 18' facing the railway platform 27, in such a manner as to displace the movable plate 5 to an embarkation position E1 and put the adjusting means 18' in the adjusting position. The movable floor 11, 11' is driven by the vertical movement of the movable plate 5.

The drive means (not shown) are, for example, pneumatic, hydraulic or electric means.

Of course, the description made above also apply to a vehicle in which a means of passage 11 connects the movable plate 5 directly to one end of the vehicle. In that case, the fixed floor 12 is, for example, a floor located in the intercirculation zone or said end of the vehicle.

The comments made above also apply to a vehicle in which the floors 12 and 12' disposed on each side of the access platform 4 extend at different heights relative to the chassis 25 of the vehicle 1.

What is claimed is:

1. A railway vehicle comprising:

an access platform which extends between two lateral faces, at least one of the faces comprising a lateral access door, the access platform being adjacent to at least one passenger area and comprising a plate which is movable vertically so as to allow passengers with reduced mobility to access/leave the access platform from/to a railway platform of a given height when said movable plate is placed in a given embarkation/disembarkation position, wherein said vehicle comprises at least a moving floor allowing persons with reduced mobility to move between said passenger area and said movable plate whatever the embarkation/disembarkation position thereof, and wherein the moving floor is located and always remains in an interior of the vehicle along with the passenger area and the movable plate between which the moving floor is located.

2. A railway vehicle according to claim 1, wherein the moving floor provides the connection between said movable plate and a fixed floor of the passenger area.

3. A railway vehicle according to claim 1, wherein the moving floor extends longitudinally between said movable plate and said fixed floor.

4. A railway vehicle according to claim 3, wherein the moving floor is joined to the movable plate and to the fixed floor so as to form a longitudinal ramp between the movable plate and the fixed floor.

5. A railway vehicle according to claim 4, wherein the inclination of said ramp varies when the movable plate is displaced vertically between the embarkation/disembarkation position and an embarkation position of a first height and an embarkation position of a second height.

6. A railway vehicle according to claim 1, wherein the access platform comprises adjusting means which make it easier for persons of reduced mobility to access said vehicle from a railway platform of the given height situated opposite the adjusting means.

7. A railway vehicle according to claim 6, wherein the adjusting means comprise a movable pallet which extends between the movable plate and a lateral access door, said movable pallet pivoting relative to the movable plate about a substantially horizontal longitudinal axis.

8. A railway vehicle according to claim 6, wherein the adjusting means comprise a closure means for limiting the distance between the movable pallet and a railway platform.

9. An access device comprising an access platform, said access platform comprising a plate which is movable vertically so as to allow passengers with reduced mobility to access the access platform from a railway platform a given height when said movable plate is placed in an embarkation position—, wherein the access device further comprises at least a moving floor permitting the movement of persons with reduced mobility between a passenger area and said movable plate whatever a given embarkation/disembarkation position of the movable plate, and wherein the moving floor is located and always remains in an interior of the vehicle along with the passenger area and the movable plate between which the moving floor is located.

10. An access device according to claim 9, further comprising adjusting means which make it easier for persons with reduced mobility to move between said movable plate and a railway platform.

11. An access device according to claim 9, wherein the moving floor extends longitudinally between said movable plate and a fixed floor of a passenger zone, said movable floor being joined to the movable plate and to the fixed floor.

12. A method for adjusting the position of the access device comprising an access platform, said access platform comprising a plate which is movable vertically so as to allow passengers with reduced mobility to access the access platform from a railway platform of a given height when said movable plate is placed in a given embarkation position, wherein the access device further comprises at least one moving floor permitting the movement of persons with reduced mobility between a passenger area and said movable plate whatever the embarkation/disembarkation position of the movable plate and wherein the moving floor is located and always remains in an interior of the vehicle along with the passenger area and the movable plate between which the moving floor is located, the method comprising the following steps:

detecting the railway platform, calculating the best arrangement of the access device in which the ramps formed by said moving floor and the adjusting means are less than 8%, bringing the movable plate into its embarkation/disembarkation position, and disposing at least the adjusting means disposed opposite the railway platform in an adjusting position in which the adjusting means reduces the distance from the access platform to the railway platform.

* * * * *